US005179743A

United States Patent [19]

Lanman

[11] Patent Number: 5,179,743

[45] Date of Patent: Jan. 19, 1993

[54] WATERBED SHEET ATTACHMENT SYSTEM

[76] Inventor: Bennie L. Lanman, 1105 E. Broadway, Princeton, Ind. 47670

[21] Appl. No.: 533,151

[22] Filed: Jun. 4, 1990

[51] Int. Cl.[5] ..... A47C 21/02

[52] U.S. Cl. ..... 5/498; 24/72.5; 24/465

[58] Field of Search ..... 5/494, 490, 498, 499; 24/72.5, 464–466

[56] References Cited

U.S. PATENT DOCUMENTS

| | | | |
|---|---|---|---|
| 579,901 | 3/1897 | Smith | 24/466 |
| 2,163,521 | 6/1939 | Schumacher | 24/466 |
| 2,284,778 | 6/1942 | Treiber | 5/498 |
| 2,326,399 | 8/1943 | Shields . | |
| 3,034,190 | 5/1962 | Magnin et al. | 24/464 |
| 3,092,848 | 6/1963 | Gronvold | 5/498 X |
| 4,222,139 | 9/1980 | Svedberg-Reker et al. . | |
| 4,520,518 | 6/1985 | Reaser . | |
| 4,541,137 | 9/1985 | Murray . | |
| 4,660,240 | 4/1987 | Hutton et al. | 5/498 X |
| 4,662,016 | 5/1987 | Seeman . | |
| 4,698,880 | 10/1987 | Hamm . | |

*Primary Examiner*—Michael F. Trettel
*Attorney, Agent, or Firm*—Andsel Group, Inc.

[57] ABSTRACT

A waterbed sheet attachment system having a waterbed harness assembly formed from a plurality of straps that criss-cross each other underneath a waterbed mattress. The outer ends of these straps are secured to sheet attachment assemblies. Each of these sheet attachment assemblies have an elongated locking member and a sheet locking bracket. The harness straps also each have a length adjustment buckle near their free ends.

3 Claims, 2 Drawing Sheets

WATERBED SHEET ATTACHMENT SYSTEM

BACKGROUND OF THE INVENTION

The invention relates to waterbeds and more specifically to a novel waterbed sheet attachment system.

Presently numerous structures exist or have been designed for capturing sheets and other bed clothing used with mattresses. The Shield, U.S. Pat. No. 2,326,399, discloses a bed clothes harness that uses eye members and elastic sections formed with heads at their ends that are attached to the bed strap harness.

The Svedberg-Reker et al, U.S. Pat. No. 4,222,139, discloses a different type of harness-like arrangement for securing a mattress pad to the top of a waterbed mattress. Murray, in U.S. Pat. No. 4,541,137, discloses the use of a plurality of individual bedding holders that are positioned around the perimeter of the mattress for securing the bedding in position.

Reaser, in U.S. Pat. No. 4,520,518, discloses structure for bed sheet installation and retention using individual cover retainer members. Seeman, in U.S. Pat. No. 4,662,016 discloses a bedclothes retainer structure that utilizes Velcro fastening structure. In U.S. Pat. No. 4,698,880, the inventor Hamm discloses bed clothing fastening structure that utilizes a clasp and a wedge member.

SUMMARY OF THE INVENTION

The novel waterbed sheet attachment system has a waterbed harness assembly formed from a plurality of straps that crisscross each other underneath a waterbed mattress. There is a central longitudinal strap, a central lateral strap, a left diagonal strap and a right diagonal strap. There is a length adjustment buckle on each of the harness straps near their free ends. One or more sheet attachment assemblies are secured to the outer ends of each of the respective strap members.

The sheet attachment assemblies each have an elongated locking member and a sheet locking bracket. The elongated locking members are in the form of a flat strip having an anchor head extending from its rear surface adjacent its top end that functions as structure for attaching the elongated locking member to the sheet locking bracket. These elongated locking members have a neck portion extending outwardly from their rear surface adjacent their bottom end and a slide lock button having a predetermined diameter is formed on the neck portion.

The sheet locking brackets are formed from a flat piece of material having a head portion and an elongated body portion having a longitudinally extending axis. A harness strap slot and an anchor head slot are formed in the head portion. The elongated body portion of the sheet locking bracket has a longitudinally extending slide lock button slot having a width that is less than the diameter of the slide lock buttons of the elongated locking members. An eyelet aperture is formed at the top end of the slide lock button slot and it has a width that is greater than the diameter of the slide lock button of the elongated locking member

DESCRIPTION OF THE PREFERRED EMBODIMENT

Figure 1:
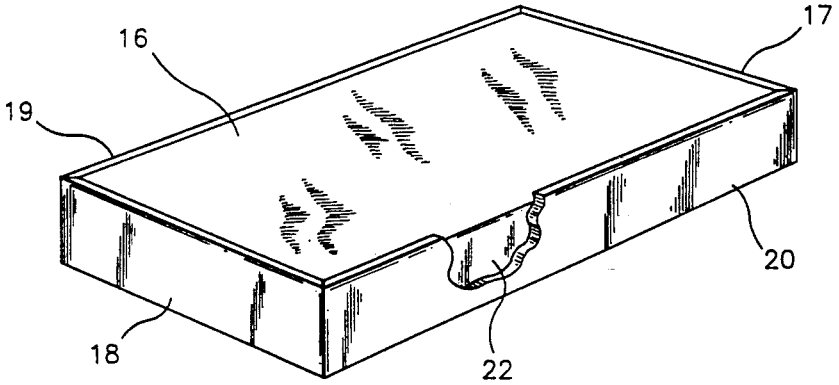
FIG. 1 is a front perspective view illustrating a waterbed.

Applicant's novel waterbed sheet attachment system will now be described by referring to FIGS. 1–11 of the drawings.

A waterbed mattress 16 is supported in a frame having a head wall 17, a foot wall 18, and laterally spaced side walls 19 and 20. A liner 22 surrounds the waterbed mattress 16 on its bottom and all of its upright sides.

Figure 2:
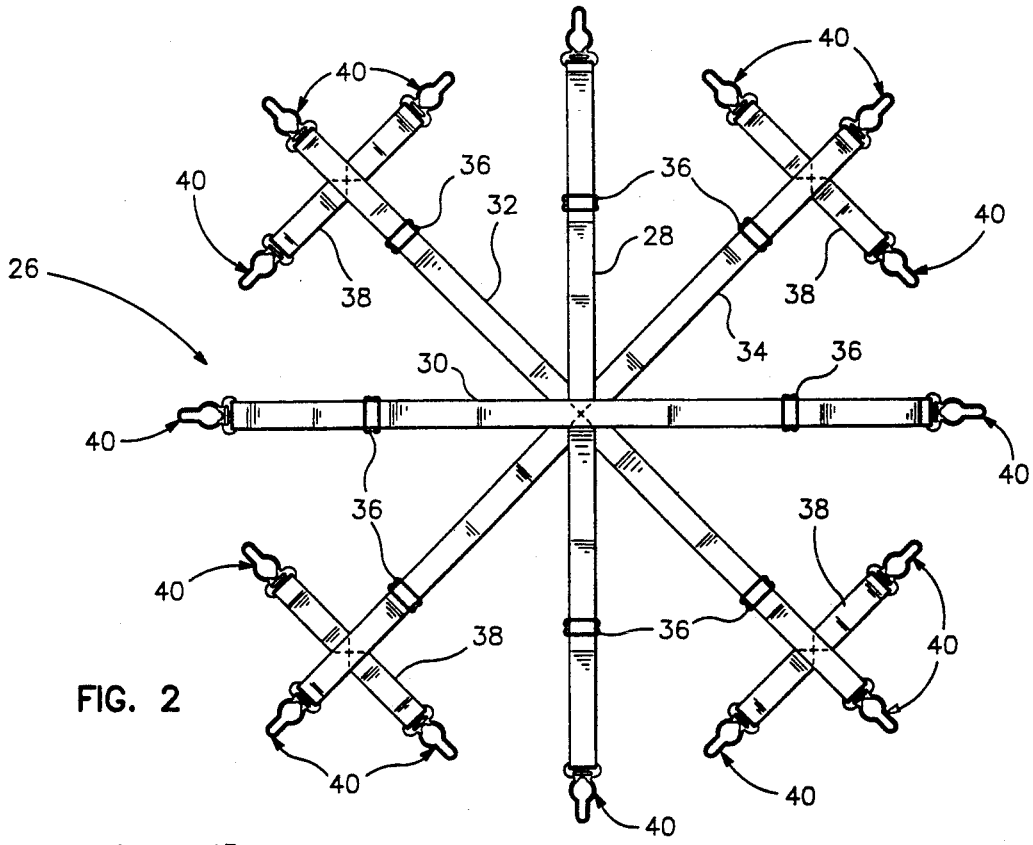
FIG. 2 is a top plan view of the waterbed harness assembly.

A waterbed harness assembly 26 such as illustrated in FIG. 2 is laid out beneath waterbed mattress 16 in the waterbed frame. Harness assembly 26 has a central longitudinal strap 28, a central lateral strap 30, a left diagonal strap 32, and a right diagonal strap 34. Where these individual straps criss-cross each other they are secured together by threaded stitching. Length adjustment buckles 36 are positioned on the individual strap members adjacent their free ends. Transverse straps 38 are secured to the respective diagonal straps adjacent their ends. All of the straps have a sheet locking bracket 40 attached to their outer ends.

Figure 3:
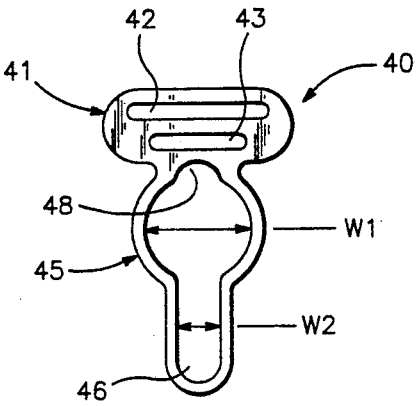
FIG. 3 is a front elevation view of a sheet locking bracket.

The specific structure of the sheet locking brackets 40 is best understood by referring to FIG. 3. They each have a head portion 41 having a harness strap slot 42 and an anchor head slot 43. Elongated body portion 45 has a slide lock button slot 46 having a width W2. An eyelet aperture 48 is formed at the top end of slide lock button slot 46 and it has a width W1.

Figure 4:
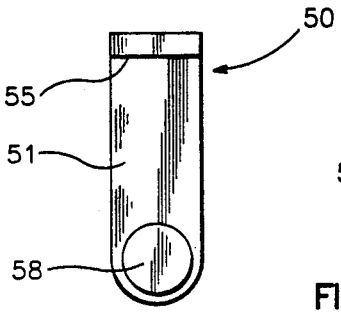
FIG. 4 is a front elevation view of the elongated locking member.
Figure 5:
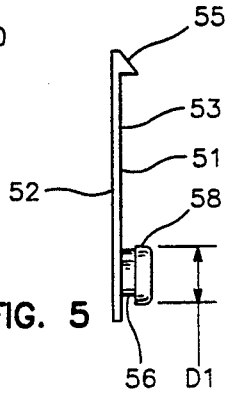
FIG. 5 is a side elevation view of the elongated locking member.

Elongated locking member 50 is illustrated in FIGS. 4 and 5. It has an elongated strip 51 having a front surface 52 and a rear surface 53. An anchor head 55 is formed at the top end and a neck portion 56 extends outwardly from elongated strip 51 adjacent its bottom end and it has a slide lock button 58 formed thereon. Slide lock button 58 has a diameter D1.

Figures 6, 7, 8, 9, 10:
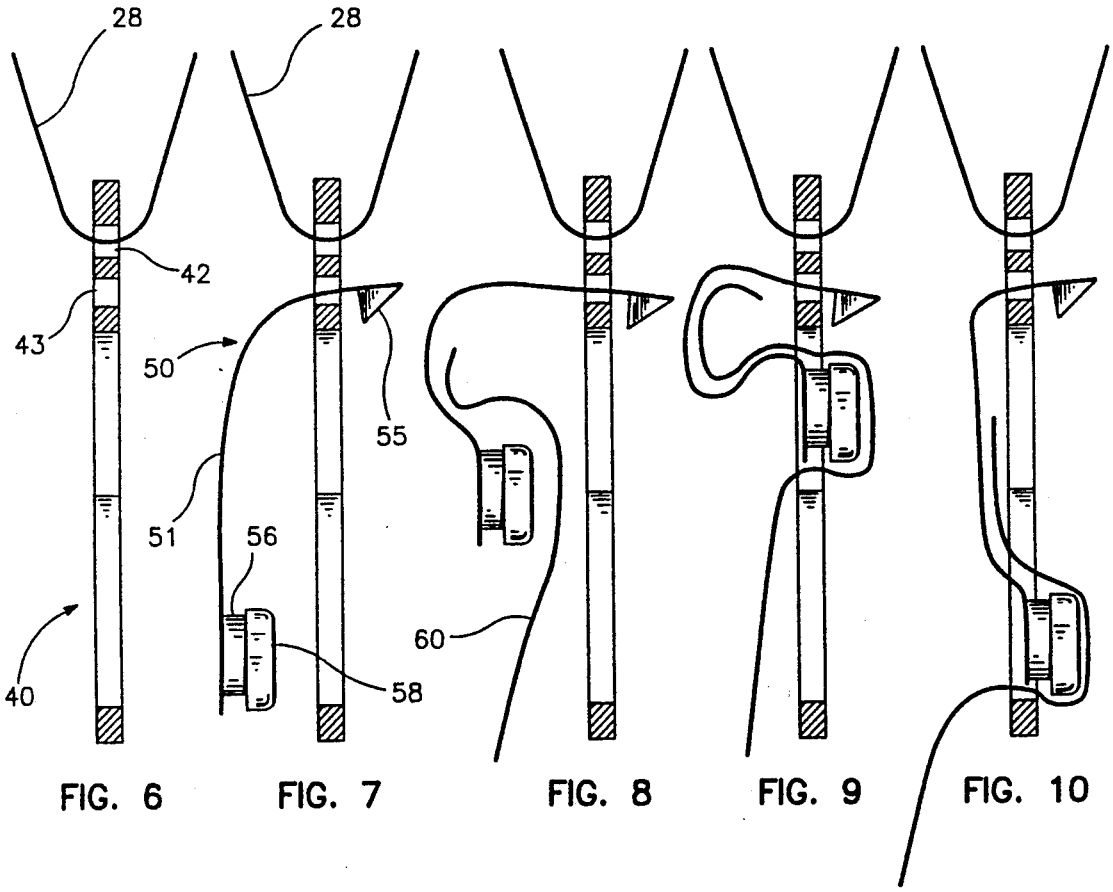
FIGS. 6–10 are schematic illustrations showing how the elongated locking member is secured to the sheet locking bracket and also how the ends of the sheets are secured to this combined structure.

Referring to FIGS. 6–10, the manner in which the elongated locking member is secured to the sheet locking bracket and the manner in which a sheet is secured by the combined structure is illustrated. In FIG. 6 the sheet locking bracket is attached to one of the straps of the waterbed harness assembly. Next in FIG. 7 the anchor head of the elongated locking member 50 is inserted into slot 43 of sheet locking bracket 40. Next a portion of the sheet 60 is positioned between slide lock button 58 and eyelet aperture 48, (See FIG. 8). In FIG. 9, slide lock button 58 along with the material of sheet 60 is pushed through eyelet aperture 48. Following this, in FIG. 10, slide lock button 58 is slid downwardly in slide lock button slot 46 to firmly to capture the edge of the sheet in sheet locking bracket 40.

Figure 11:
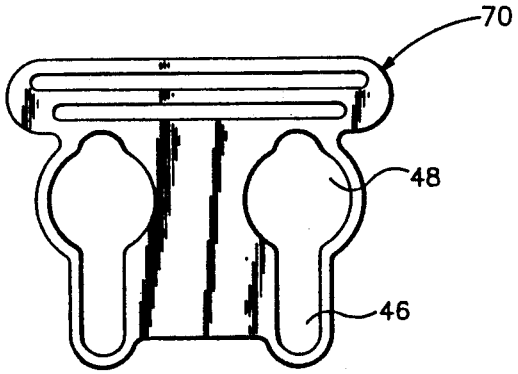
FIG. 11 is a front elevation view of an alternative sheet locking bracket.

An alternative sheet locking bracket 70 is illustrated in FIG. 11. It is substantially the same as sheet locking bracket 40, except it has a second eyelet aperture 48 and slide lock button slot 46.

The following procedure is recommended when using the applicant's novel waterbed sheet attachment system. First the waterbed mattress must be drained and removed. Then the waterbed harness assembly is laid on the pedestal platform in the manner illustrated in FIG. 2. The diagonal straps of the harness would extend to the respective corners. Following this the mattress is replaced on the platform and filled with water. The fitted sheet is then replaced as usual starting at the head of the bed where the sheet is attached to the sheet locking bracket. Next the sheet is attached at the foot of the bed and then on each of the lateral sides. With the four sides secured the sheet locking brackets are then attached at the corners of the waterbed. When completed, all four sides and corners are secured (a total of sixteen attachment points) and the sheet stays securely in place.

What is claimed is:

1. A waterbed sheet attachment system comprising:

a waterbed harness assembly formed from a plurality of straps that criss-cross each other underneath a waterbed mattress, these straps having outer ends to which are secured sheet attachment assemblies;

a plurality of sheet attachment assemblies each having an elongated locking member and a sheet locking bracket;

said elongated locking member is in the form of a flat strip having a top end, a bottom end, a front surface and a rear surface, an anchor head extends from said rear surface adjacent said top end, said anchor head functions as structure for attaching said elongated locking member to said sheet locking bracket;

said elongated locking member has a neck portion extending outwardly from its rear surface adjacent its bottom end and a slide lock button having a predetermined diameter D1 is formed on said neck portion;

said sheet locking bracket is formed from a flat piece of material having a head portion and an elongated body portion having a longitudinally extending axis, a harness strap slot and an anchor head slot are formed in said head portion;

the elongated body portion of said sheet locking bracket has a longitudinally extending slide lock button slot having a predetermined width W2 that is less than D1, an eyelet aperture is formed at the top end of said slide lock button slot and it has a width W1 that is greater than D1; and said waterbed harness assembly has a central longitudinal strap, a central lateral strap, a left diagonal strap and a right diagonal strap that criss-cross and are stitched together as one.

2. A waterbed sheet attachment system as recited in claim 1 wherein each of said harness straps have a length adjustment buckle near their free ends.

3. A waterbed sheet attachment system comprising:

a waterbed harness assembly formed from a plurality of straps that criss-cross each other underneath a waterbed mattress, these straps having outer ends to which are secured sheet attachment assemblies;

a plurality of sheet attachment assemblies each having an elongated locking member and a sheet locking bracket;

said elongate locking member is in the form of a flat strip having a top end, a bottom end, a front surface and a rear surface, an anchor head extends from said rear surface adjacent said top end, said anchor head functions as structure for attaching said elongated locking member to said sheet locking bracket;

said elongated locking member has a neck portion extending outwardly from its rear surface adjacent its bottom end and a slide lock button having a predetermined diameter D1 is formed on said neck portion;

said sheet locking bracket is formed from a flat piece of material having a head portion and an elongated body portion having a longitudinally extending axis, a harness strap slot and an anchor head slot are formed in said head portion;

the elongated body portion of said sheet locking bracket has a longitudinally extending slide lock button slot having a predetermined width W2 that is less than D1, an eyelet aperture is formed at the top end of said slide lock button slot and it has a width W1 that is greater than D1;

said waterbed harness assembly has a central longitudinal strap, a central lateral strap, a left diagonal strap and a right diagonal strap that criss-cross and are stitched together as one; and each of said harness straps have a length adjustment buckle near their free ends.

* * * * *